United States Patent [19]

Sheldon

[11] 4,423,661

[45] Jan. 3, 1984

[54] RAIL LAUNCHER

[75] Inventor: David W. Sheldon, Westford, Mass.

[73] Assignee: Raytheon Company, Lexington, Mass.

[21] Appl. No.: 344,899

[22] Filed: Feb. 1, 1982

[51] Int. Cl.[3] ..... F41F 7/00

[52] U.S. Cl. ..... 89/1.819; 89/1.8; 89/1.815

[58] Field of Search ..... 89/1.819, 1.815, 1.8, 89/1.806; 244/137 R

[56] References Cited

U.S. PATENT DOCUMENTS

| | | | |
|---|---|---|---|
| 3,040,629 | 6/1962 | Duncan et al. | 89/1.819 X |
| 3,179,010 | 4/1965 | Bratton | 89/1.819 |
| 3,771,416 | 11/1973 | Ackerman et al. | 89/1.819 X |

*Primary Examiner*—David H. Brown

*Attorney, Agent, or Firm*—Philip J. McFarland; Joseph D. Pannone

[57] ABSTRACT

A rail launcher for a guided missile is shown to include a pair of movable sections, each actuable first to form a gap in an otherwise continuous rail for receiving a lug affixed to a guided missile and then to return to an initial position, capturing such lug and forming a track.

4 Claims, 3 Drawing Figures

RAIL LAUNCHER

The Government has rights in this invention pursuant to Contract No. F08635-79-C-0043 awarded by the Department of the Air Force.

BACKGROUND OF THE INVENTION

This invention pertains generally to rail launchers for missiles and particularly to an improved loading and unloading mechanism for such types of launchers.

Modern fighter aircraft may be equipped with a variety of ordnance, including bombs, rocket launchers, and both short and medium range air-to-air missiles. The ordnance carried at any given time by such aircraft is, of course, dependent on the particular type of mission to be carried out. That is to say, if a fighter aircraft were to engage in an air defense mission, only short and medium range air-to-air missiles would be carried. On the other hand, if such aircraft were to engage in a ground support or other attack mission, then most of the air-to-air missiles would be replaced by bombs or rocket launchers, with only a few short range air-to-air missiles carried for defensive purposes against other aircraft. Obviously, then, it would be highly advantageous to have launchers that accommodate short and medium range air-to-air missiles.

The most common type of missile launcher now used for either short or medium range missiles is the so-called "rail" launcher, designed to interface with "hooks" or "lugs" provided on the body of the air-to-air missiles. Unfortunately, the mating of the missile hooks or lugs to any known design of a rail launcher is a labor intensive, time consuming operation. That is to say, in order to load either a short or medium range missile on any known rail launcher the missile to be loaded must first be positioned so that the lug nearer the rear of the missile is aligned with the forward end of the rail launcher and then such missile must be moved relative to the launcher until a second lug near the front of the missile engages the rail launcher. The missile to be loaded is then moved more relative to the launcher until a detent arrangement (say that described in U.S. Pat. No. 3,040,629) is activated so that the missile is held in a fixed position on the rail launcher. It should be apparent from the foregoing that manual loading of a missile on any known type of rail launcher requires a minimum of three persons, two to lift and align the missile with the rail launcher and one to operate the detent arrangement.

SUMMARY OF THE INVENTION

With this background of the invention in mind, it is an object of this invention to provide an improved rail launcher wherein the number of persons required to effect loading of any known type of short or medium range air-to-air missiles is reduced to a minimum.

It is another object of this invention to provide an improved missile rail launcher that substantially reduces the time required to load and unload missiles.

The foregoing and other objects of the invention are attained generally by providing a rail launcher having movable sections along the length of a rail, such sections being arranged to allow the lugs on a missile to be positioned without having to slide the missile along the rail. The act of positioning of the missile then causes the movable sections automatically to form a substantially continuous rail on which the missile is held until launching or unloading is desired.

BRIEF DESCRIPTION OF THE DRAWINGS

Other objects and many of the attendant advantages of this invention will be readily appreciated as the same becomes better understood by reference to the following detailed description when considered in connection with the accompanying drawings wherein.

DESCRIPTION OF THE PREFERRED EMBODIMENT

Figure 1:
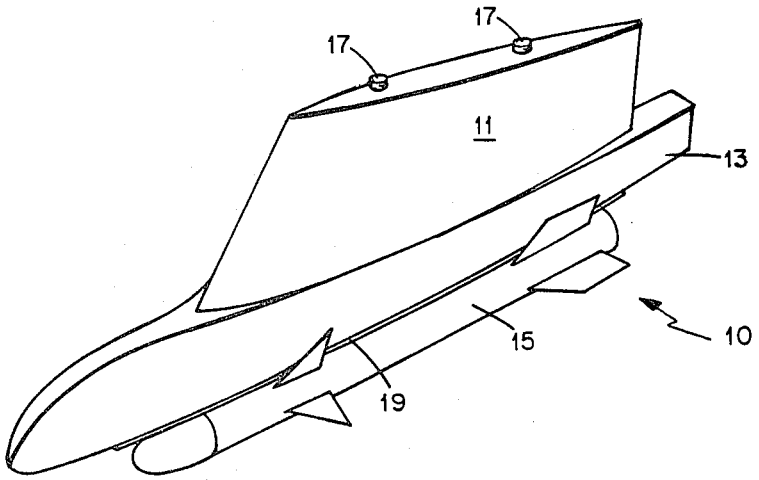
FIG. 1 is a simplified sketch of a rail launcher according to this invention having a missile attached thereto.

Referring now to FIG. 1, a missile rail launcher 10 is shown to comprise a streamlined pylon assembly 11 (which, of course, is attached to the wing of an aircraft (not shown) in any convenient known manner as by bolts 17) and a launcher frame 13. A missile 15 (either a short or medium range guided missile) is shown attached to a rail 19 on a launcher frame 13 as such a missile would be carried during a mission.

Figures 2A, 2B:
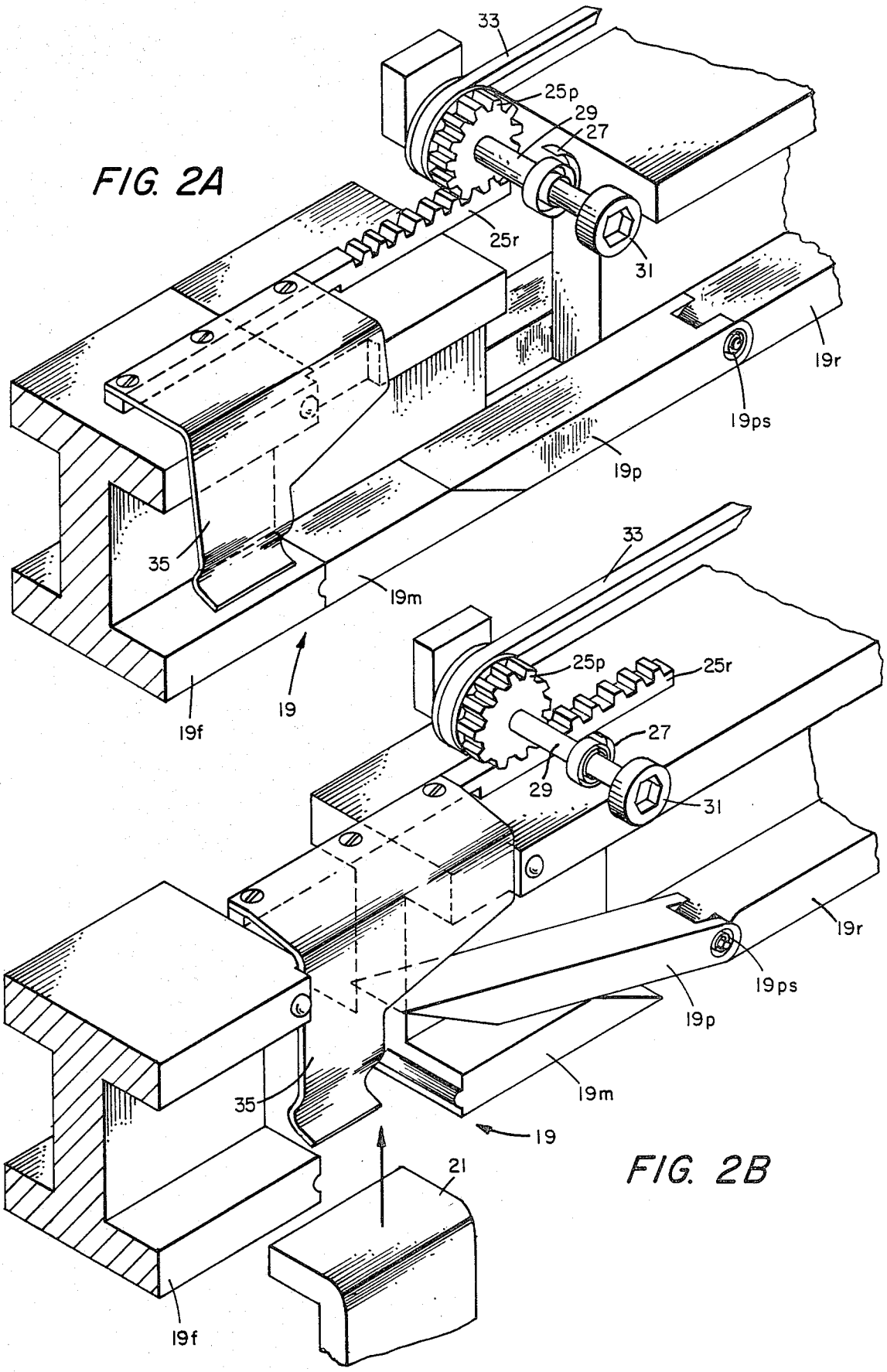
FIGS. 2A and 2B are sketches showing how movable sections of the rail in the rail launcher of FIG. 1 may be moved.

Before referring to FIGS. 2A and 2B in detail, it should be noted that, for ease of illustration, known conventional elements, ordinarily incorporated in the launcher frame 13 (FIG. 1), but not required for an understanding of this invention, have not been illustrated. For example, connection means for an umbilical cord, sway wedges and detents (such as are shown in U.S. Pat. No. 3,040,629) for holding the missile 15 (FIG. 1) in place during flight have not been shown. Further, it should be noted also that the details of only a single movable section of the launcher frame 13 (FIG. 1) has been shown because the second movable section is the same as the first. In addition, the illustration has been simplified by not showing conventional elements such as bearings.

With the foregoing in mind, it may now be seen in FIGS. 2A and 2B that an arrangement according to this invention is operable first to move a slidable section **19*m* to provide an opening (not numbered) in the rail 19 for accommodating a lug 21 affixed to a missile 15 and then, when the lug 21 is in the opening, to cause the section 19*m* to return to alignment with the rail 19. Thus, the rail 19 is made up of a forward I-bar 19*f*, the slidable section 19*m*, a pivotable plate 19*p* and a rear I-bar 19*r* which, as shown in FIG. 2A, form the rail 19. The two I-bars are affixed in any convenient manner (not shown) to the launcher frame 13 (FIG. 1) while the slidable section 19*m* is slidably mounted on the launcher frame 13. The pivotable plate 19*p* is hinged, as shown, on the rear I-bar 19*r* with springs 19*ps*. The mating faces (not numbered) of the slidable section 19*m* and the pivotable plate 19*p* are, as shown in FIG. 2A, shaped to form a wedge so that, as the slidable section 19*m* is moved toward the hinge (not numbered) of the pivotable plate 19*p*, that plate is rotated upwardly to the position shown in FIG. 2B**.

A rack **25*r* and pinion 25*p* are disposed, as shown, on the upper side of the slidable section 19*m*, i.e., within the launcher frame 13. A restoring spring (here spring 27) is mounted between the launcher frame 13 and a supporting shaft 29 for the pinion 25*p*. An actuating knob 31 projecting outside the launcher frame 13 is affixed to the supporting shaft 29. A drive belt 33 around the supporting shaft 29 is led to the supporting shaft (not shown) of a second movable section which is similar to the one just described. It will now be apparent that rotation of the actuating knob 31, as by a wrench (not shown), causes the slidable section 19***m* to be moved rearwardly away from the forward rail 19*f*, thereby forming an opening (not numbered but shown in FIG. 2B) between the two elements.

When the slidable section 19*m* has been moved rearwardly to form the opening for the lug 21 (FIG. 2B), the forward end of a sear spring 35 clears the rear side of the forward I-bar 19*f*. The sear spring 35, mounted in any convenient manner on the slidable section 19*m* as shown, snaps into the then extant opening between the forward I-bar 19*f* and the slidable section 19*m*. The sear spring 35 then is effective to prevent movement of the slidable section 19*m*, i.e. the slidable section 19*m* may be deemed to be in a cocked position wherein the opening for the lug 21 is maintained.

The free end of the sear spring 35 is shaped as shown and positioned so that, when the lug 21 comes into contact with the sear spring 35, that spring is forced out of space between the forward I-bar 19*f* and the slidable section 19*m*. As a result, then, the slidable section 19*m* is forced (by operation of the spring 27) back toward the forward I-bar 19*f* to capture the lug 21 in the process and the rotatable section 19*r* is moved back into alignment with the slidable section 19*m* and the rear I-bar 19*r* by operation of spring 19*ps*.

Having described a preferred embodiment of this invention, it will be apparent to one of skill in the art that many changes and modifications may be made without departing from my inventive concepts. It is felt, therefore, that coverage should not be limited to the disclosed embodiment, but rather should be limited only by the spirit and scope of the appended claims.

I claim:

1. In a rail launcher wherein a pair of lugs affixed to a guided missile may slide along a substantially continuous rail, the improvement comprising:

(a) a first movable section of rail initially aligned with the substantially continuous rail, one end of such first movable section normally abutting a first fixed section of such rail;

(b) a second movable section of rail initially aligned with the substantially continuous rail, one end of such second movable section normally abutting the second end of the first movable section and the second end of such second movable section being hinged to a second fixed section of such rail; and (c) a wedge formed by the abutting ends of the first and the second movable sections.

2. The improvement as in claim 1 having, additionally, means for sliding the first movable section toward the second movable section, thereby rotating the second movable section and forming a space between the first movable section and the first fixed section to accommodate one of the pair of lugs.

3. The improvement as in claim 2 having, additionally, means for latching the first movable section in position to maintain the space between the first movable section and the first fixed section.

4. The improvement as in claim 3 having, additionally, means, responsive to one of the lugs, when such lug is inserted in the space between the first movable section and the first fixed section, for unlatching the first movable section to cause such section, and the second movable section, to the initial position.

* * * * *